United States Patent [19]

Salice

[11] Patent Number: 4,674,150

[45] Date of Patent: Jun. 23, 1987

[54] HINGE BRACKET AND MOUNTING PLATE ASSEMBLY

[75] Inventor: Luciano Salice, Carimate, Italy

[73] Assignee: Arturo Salice, S.p.A., Novedrate, Italy

[21] Appl. No.: 558,588

[22] Filed: Dec. 6, 1983

[30] Foreign Application Priority Data

Dec. 7, 1982 [DE] Fed. Rep. of Germany ..... 3245227

[51] Int. Cl.[4] ..... E05D 7/04

[52] U.S. Cl. ..... 16/382; 16/246; 16/238; 403/362

[58] Field of Search ..... 16/233, 235, 238–240, 16/242–243, 245–249, 341, 338, 374, 375, 362–364, DIG. 43; 403/362

[56] References Cited

U.S. PATENT DOCUMENTS

| | | | |
|---|---|---|---|
| 2,893,764 | 7/1959 | Ferguson | 16/248 |
| 3,772,735 | 11/1973 | Lautenschlaeger | 16/237 |
| 3,863,292 | 2/1975 | Grunert et al. | 16/236 |
| 3,913,173 | 10/1975 | Rock et al. | 16/237 |
| 4,011,627 | 3/1977 | Salice | 16/239 |
| 4,109,344 | 8/1978 | Rock et al. | 16/DIG. 43 X |
| 4,112,543 | 9/1978 | Rock et al. | 16/DIG. 43 X |
| 4,411,045 | 10/1983 | Rock et al. | 16/243 |
| 4,434,523 | 3/1984 | Grass | 16/382 |

FOREIGN PATENT DOCUMENTS

| | | | |
|---|---|---|---|
| 2806958 | 8/1978 | Fed. Rep. of Germany | 16/242 |
| 2730940 | 1/1979 | Fed. Rep. of Germany | 16/236 |
| 1506252 | 4/1978 | United Kingdom | 16/235 |

*Primary Examiner*—Donald R. Schran
*Assistant Examiner*—James L. Wolfe
*Attorney, Agent, or Firm*—Morgan & Finnegan

[57] ABSTRACT

In a hinge bracket and mounting plate assembly, the mounting plate has guides, in which the hinge bracket is slidable in its longitudinal direction for a depth adjustment and in which the hinge bracket and the mounting plate are interconnected by a fixing screw, which is screwed into the mounting plate and extends through a slot formed in the hinge bracket, an adjusting screw is screwed in a tapped bore of the hinge bracket and is backed by the mounting plate, and the mounting plate has fixing holes, which preferably consist of slots, which extend transversely to the hinge bracket so as to permit a vertical adjustment. The backing surface which is provided on the mounting plate and engageable by the adjusting screw rises toward the hinge-carrying end of the hinge bracket.

2 Claims, 3 Drawing Figures

HINGE BRACKET AND MOUNTING PLATE ASSEMBLY

BACKGROUND OF THE INVENTION

This invention relates to a hinge bracket and mounting plate assembly, in which the mounting plate has guides, in which the hinge bracket is slidable in its longitudinal direction for a depth adjustment and in which the hinge bracket and the mounting plate are interconnected by a fixing screw, which is screwed into the mounting plate and extends through a slot formed in the hinge bracket, an adjusting screw is screwed in a tapped bore of the hinge bracket and is backed by the mounting plate, and the mounting plate has fixing holes, which preferably consist of slots, which extend transversely to the hinge bracket so as to permit a vertical adjustment.

The mounting plate is usually screwed to a carrying wall of a piece of furniture or the like at predetermined locations so that the hinge bracket, which is connected to a door or hinged cover by a hinge, is adapted to be secured to the mounting plate by means of the fixing screw. Owing the slots provided in the mounting plate and in the hinge bracket, the latter is adapted to be adjusted in a vertical direction for an adjustment in height and in a horizontal direction for a depth adjustment. The clearance left between the door or the like and the carrying wall can be adjusted by the adjusting screw.

The means for securing the hinge bracket will be subjected to certain normal stresses during the closing and opening of the door or the like. Additional loads may be imposed on the hinge bracket when the door is opened beyond a predetermined limit or relatively heavy clothes or the like are suspended from the open door. Such loads may cause the hinge bracket to perform a sliding movement relative to the mounting plate and the mounting plate to become loose so that the joint between the hinge bracket and the mounting plate is slackened and a smooth opening and closing of the door may no longer be possible.

From German Patent Publication 14 59 059 it is known that unintended longitudinal displacements of the hinge bracket relative to its mounting plate can be prevented in that the mounting plate is formed with transversely extending grooves, which receive ribs protruding from the hinge bracket so that the two parts will interengage when they are connected by a screw.

From German Patent Publication 21 30 779 it is known to provide the edges of the slot formed in the hinge bracket with closely spaced, overlapping circular grooves and to provide the head of the fixing screw at its lower edge with a protruding circular ridge, which is adapted to enter one of said grooves. Such positive joints provided by grooves and by ribs or ridges which enter said grooves add substantially to the manufacturing costs and permit an adjustment only in steps which are determined by the spacing of the grooves whereas an infinite adjustment is not possible.

In a known hinge bracket and mounting plate assembly of the kind described first hereinbefore, the edges of the slot of the hinge bracket rise in wedge shape toward that end of the hinge bracket which is opposite to the hinge. Whereas such hinge bracket will be additionally forced against the mounting plate by a tensile force acting on the hinge bracket in the direction toward its hinge-carrying end, the hinge bracket will become loose immediately under the action of a force acting in the opposite direction. Such oppositely directed force may occur when pressure is applied to the open door. It is apparent that in the use of that known hinge assembly the advantage afforded by the additional initial stress due to the wedge action under a force acting in one direction will be offset by the fact that the joint is much more susceptible to slackening under an oppositely directed load.

For this reason it is an object of the invention to provide a hinge bracket and mounting plate assembly in which said parts are infinitely adjustable relative to each other and can be connected to each other by a screw in such a manner that the joint will be strengthened by forces acting on the hinge bracket in the direction toward its end carrying the hinge whereas a quick loosening under the action of forces exerted in the opposite direction need not be feared.

BRIEF STATEMENT OF THE INVENTION

This object is accomplished in accordance with the invention in that the backing surface which is provided on the mounting plate and engageable by the adjusting screw rises toward the hinge-carrying end of the hinge bracket. The hinge bracket according to the invention is connected to the mounting plate in the conventional manner by means of a fixing screw, which extends through a slot in the hinge bracket so that the two parts are interconnected by a conventional joint having the usual strength. But when the hinge bracket is subjected to a tensile force in the direction toward the hinge-carrying end of the hinge bracket, as may be the case when the door is excessively opened, then the strength of the joint will be increased because the adjusting screw bears on a wedgelike ramp so that the hinge bracket and mounting plate are forced against each other by an additional force. In case of a force tending to displace the hinge bracket in the opposite direction, the joint between the hinge bracket and the mounting plate still has the usual strength and a rapid loosening by a sliding of parts of the fixing screw on declining wedgelike backing surfaces need not be feared.

According to a further feature of the invention the edges of the slots which are formed in the mounting plate and extend transversely to the longitudinal direction of the hinge bracket rise outwardly in wedge shape. Because there are two wedge surfaces rising in mutually opposite directions, one wedge surface will always cooperate with the head of the associated fixing screw to apply additional stress to the joint regardless of the direction in which an additional load is applied.

THE DRAWINGS

An illustrative embodiment of the invention will now be explained more in detail with reference to the drawing, in which FIG. 1 is a top plan view showing a mounting plate, FIG. 2 is a sectional view taken on line II—II of FIG. 1 and FIG. 3 is a longitudinal sectional view showing the mounting plate of FIG. 1 and a hinge bracket connected to said mounting plate by a screw.

DESCRIPTION OF THE PREFERRED EMBODIMENTS

Figure 1:
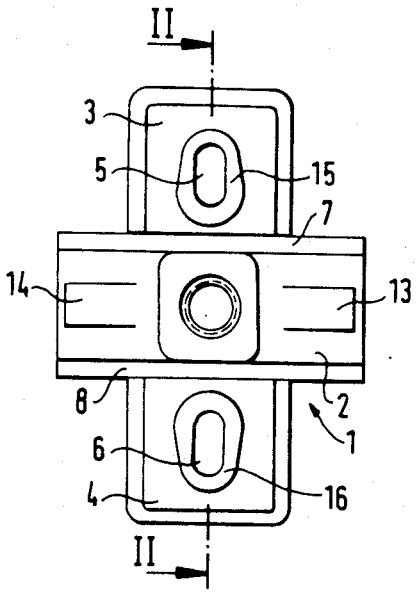

The mounting plate 1 comprises an elongate rectangular central part 2 and rectangular wings 3, 4, which are joined to opposite sides of the central region of the central part 2 and are formed with slots 5, 6 for the fixing of the mounting plate 1. These slots 5, 6 extend transversely to the longitudinal center line of the central part 2. Grooves 7 and 8 are provided between the central part 2 and the wings 3, 4 and serve to guide the lower edge portions of the flanges 9 of the hinge bracket 10, which is approximately channel-shaped.

The central part 2 is formed in its central region with a tapped bore 11 for engaging a fixing screw 12. The central portion is also provided adjacent to its ends with ramps 13, 14, each of which rises in wedge shape toward the adjacent end.

Figure 2:
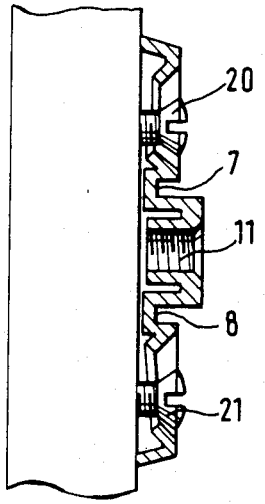

As is apparent from FIGS. 1 and 2, the edges 15 and 16 of the slots 5, 6 rise in wedge shape toward the ends of the wings 3, 4.

The hinge bracket is formed in its intermediate portion with a slot 17, and the head of the fixing screw 12 bears on the edge of the slot 17. The hinge bracket 10 is also formed with a tapped bore for engaging an adjusting screw 18. As is apparent from FIG. 3, the lower end of the adjusting screw 18 bears on the wedge-shaped ramp 13 of the central part 2 of the mounting plate 1.

The mounting plate 1 is symmetrical with respect to its vertical center line II—II so that the hinge bracket can be mounted on the mounting plate 1 so as to extend to the left or to the right from the plate. In dependence on the orientation of the hinge bracket, the adjusting screw 18 bears on the wedge-shaped ramp 13 or 14.

Figure 3:
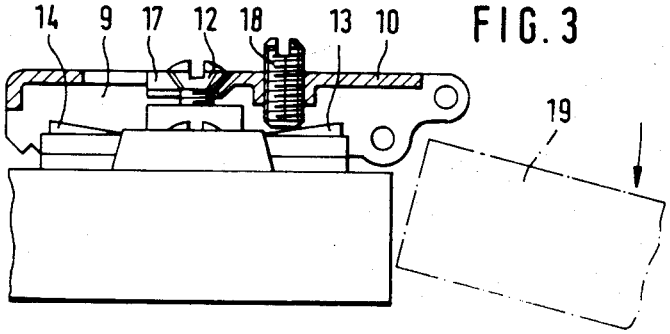

In FIG. 3, dotted lines indicate a door 19, which has been opened slightly beyond its normal open position so that the door exerts via its hinge a tensile force on the hinge bracket 10 toward its hinge-carrying end. It is apparent from FIG. 3 that that tensile force will cause the hinge arm to be forced more strongly against the mounting plate 1 because the adjusting screw 18 is pulled up along the ramp 13 so that an additional force is exerted. In case of a load imposed in the opposite direction, the usual joint between the hinge bracket and the mounting plate is provided by the fixing screw 12.

As is apparent from FIG. 2, the heads of the fixing screws 20, 21 of the mounting plate 1 bear on the wedge-shaped edges 15, 16 of the slots 5, 6. As the wedge-shaped edges 15, 16 are oppositely inclined, an additional force will be exerted in response to additional loads imposed in upward and downward directions.

What is claimed is:

1. In a hinge bracket and mounting plate assembly, in which the mount plate is provided with a backing surface and guides in which the hinge bracket is slidable in a longtudinal direction for a depth adjustment and in which said hinge bracket and said mounting plate are interconnected by a fixing screw which is screwed into said mounting plate and which extends through a slot formed in said hinge bracket, and an adjusting screw is screwed in a tapped bore in said hinge bracket and is backed by said mounting plate, said mounting plate has fixing holes which extend transversely to said hinge bracket so as to permit a vertical adjustment thereof, the improvement comprising wedge-shaped ramps located on the backing surface of said mounting plate which are engageable by said adjusting screw and each of which rises in wedge shape towards the adjacent end of said mounting plate.

2. A hinge bracket and mounting plate assembly according to claim 1, wherein the fixing holes in the mounting plate are slots and the edges of said slots extend transversely to the longitudinal direction of the hinge bracket and rise outwardly in wedge shape.

* * * * *